US005443391A

United States Patent [19]

Maeda et al.

[11] Patent Number: 5,443,391

[45] Date of Patent: Aug. 22, 1995

[54] ELECTRIC WIRE-CONNECTING TERMINAL

[75] Inventors: Osamu Maeda; Yoshio Higuchi, both of Daito, Japan

[73] Assignee: Funai Electric Co., Ltd., Daito, Japan

[21] Appl. No.: 143,869

[22] Filed: Oct. 27, 1993

[30] Foreign Application Priority Data

Dec. 29, 1992 [JP] Japan ..... 4-361366

[51] Int. Cl.[6] ..... H01R 9/09

[52] U.S. Cl. ..... 439/84; 439/741

[58] Field of Search ..... 439/84, 741, 743, 870, 439/856

[56] References Cited

U.S. PATENT DOCUMENTS

| | | | |
|---|---|---|---|
| 2,296,346 | 9/1942 | Hearn | 439/741 |
| 3,106,436 | 10/1963 | Weiss | 439/741 |
| 3,152,853 | 10/1964 | Scott | 439/741 |
| 5,145,408 | 1/1992 | Houtteman et al. | 439/581 |
| 5,281,770 | 1/1994 | Kamei et al. | 439/84 X |

FOREIGN PATENT DOCUMENTS

| | | | |
|---|---|---|---|
| 0326141 | 1/1989 | European Pat. Off. . | |
| 0148878 | 6/1990 | Japan | 439/84 |
| 0833639 | 12/1956 | United Kingdom . | |
| 1209158 | 12/1967 | United Kingdom . | |
| 2256541 | 8/1992 | United Kingdom . | |

OTHER PUBLICATIONS

Western Electric Technical Digest No. 12 by R. E. Hotze & J. B. Krepp pp. 15 & 16, Oct. 1968.

*Primary Examiner*—Z. R. Bilinsky

*Attorney, Agent, or Firm*—Lackenbach Siegel Marzullo Aronson & Greenspan

[57] ABSTRACT

The object of the present invention is to provide an electric wire-connecting terminal inserted and soldered in a printed circuit board using the conventional automatic electronic parts-inserting machine, by shaping the electric wire connecting terminal to conform to the packaging of the electronic parts on continuous tape. In order to attain that object, the electric wire-connecting terminal 30 is composed with a cylindrical sleeve 31 and a pair of L-shaped legs 32, 32 installed integrally in one piece on the upper portion of the cylindrical sleeve 31, and the legs 32, 32 cut and bent after insertion into the printed circuit board 10.

2 Claims, 4 Drawing Sheets

ELECTRIC WIRE-CONNECTING TERMINAL

BACKGROUND OF THE INVENTION

The present invention relates generally to an electric wire-connecting terminal and, more particularly, relates to an electric wire-connecting terminal insertable in a printed circuit board.

Generally, when installing a power supply cord in a printed circuit board, that cord is soldered to the circuit board after the cord wire is inserted in a hole punched on the circuit board.

Up to the present, in order to conform to European safety standards and the like, as shown in FIG. 7, a grommet 20 equivalent to an electric wire-connecting terminal is inserted downwardly by hand (as shown with an arrow) into a round hole 11 punched on the printed circuit board 10 from the upper surface of the circuit board, then the flange portion 21 facing the bottom surface of the circuit board is exclusively caulked by applying a caulking tool and is joined to a circuit 12 of the circuit board by soldering as shown in FIG. 8.

However, in electric wire-connecting terminals according to such conventional art, the grommet 20 is inserted in the PCB by the printed circuit board maker. If the work is not done by the printed circuit board maker, it is necessary to caulk the grommet to the PCB one by one by applying exclusive caulking tools apart from the inserting process of other electric parts, which required considerable labor and time.

The present invention was developed to solve the above-mentioned problem, and the object thereof is to provide an electric wire-connecting terminal joinable to the printed circuit board at the same time it is inserted therein, by using a conventional automatic electronic parts-inserting machine.

SUMMARY OF THE INVENTION

The present invention has been developed in order to remove the above-described drawbacks inherent in the conventional art, and is characterised by comprising:

- a cylindrical sleeve insertable downwardly in a round hole punched in the printed circuit board; and
- a plurality of legs integrally shaped from one piece and being apart from each other by 180° on the upper side of the cylindrical sleeve of the terminal, the legs are able to be bent towards the specified directions at the tip portions thereof after insertion in a plurality of the leg-inserting holes punched on both sides of the round hole of the printed circuit board.

With respect to the present invention, as the pair of legs which are integrally formed from one piece on the upper portion of the cylindrical sleeve of the terminal is equivalent to the leads of the packaging of electronic components on continuous tapes, it becomes possible to use a conventional automatic electronic parts-inserting machine for inserting the terminal in the printed circuit board by taping the legs of the terminal.

Still other features and advantages of the present invention will be apparent from the following description taken with reference to the accompanying drawings.

DETAILED DESCRIPTION OF THE INVENTION

Figure 1:
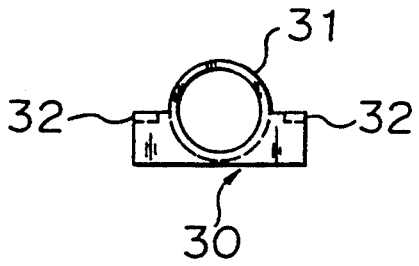
FIG. 1 is a plan view of an embodiment of the electric wire-connecting terminal according to the present invention.

A preferred embodiment according to the present invention is described in detail with reference to the related drawings as follows.

First, the construction of the electric wire-connecting terminal according to the present invention is described. Parts of the terminal that are the same as the conventional terminal are designated with the same reference numerals.

Figure 5:
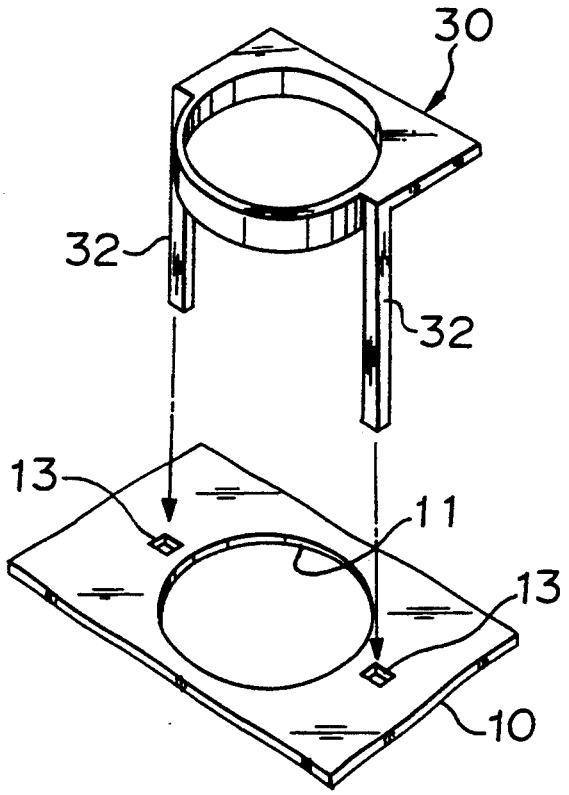
FIG. 5 is a perspective view showing the embodiment of the electric wire-connecting terminal according to the present invention which is being inserted into the printed circuit board.

As shown in FIG. 1 and FIG. 5, the electric wire-connecting terminal 30 for connecting an electric power source cord to the printed circuit board 10 is comprised of a cylindrical sleeve 31 through which the electric power source cord (not shown) passes, and a pair of legs 32, 32 like plates made integrally in one piece, on the upper portion of the cylindrical sleeve 31. Each profile of the legs 32, 32 may be approximately elliptical and used in general as leads of the electronic component instead of the profile like plates as shown in the drawing.

The height H of the cylindrical sleeve 31 is larger than the thickness of the printed circuit board 10. Lengths L of the legs 32, 32 are shaped considerably longer than the thickness T of the printed circuit board 10, and are able to be cut and bent after being inserted in the printed circuit board through the automatic inserting machine and finally soldered.

Figure 2:
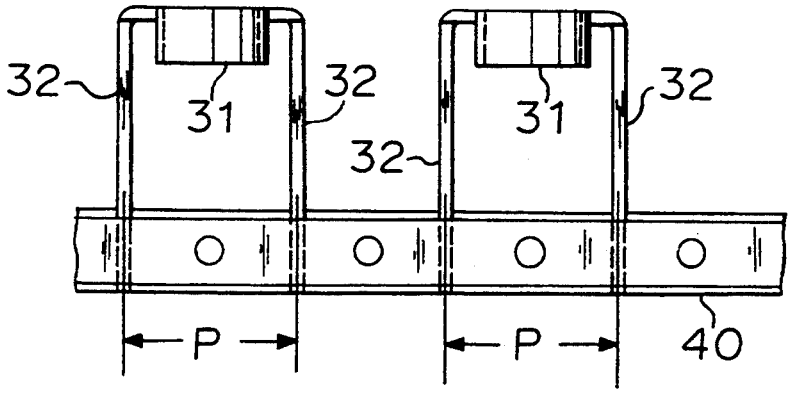
FIG. 2 is a plan view of a packaging of the connecting terminals taped serially on continuous tape.

In FIG. 2 a pair of tapes 40, usually composed with an adhesive tape and a kraft paper backing tape (non-adhesive), hold legs 32, 32 between the tapes.

Figure 6:
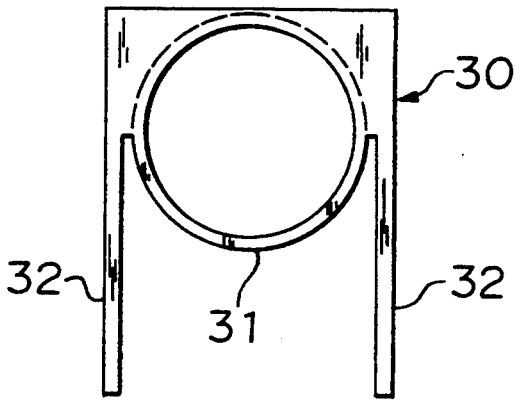
FIG. 6 is a plan view of the embodiment of the electric wire-connecting terminal according to the present invention shown in FIG. 5 before the legs are bent.
Figure 7:
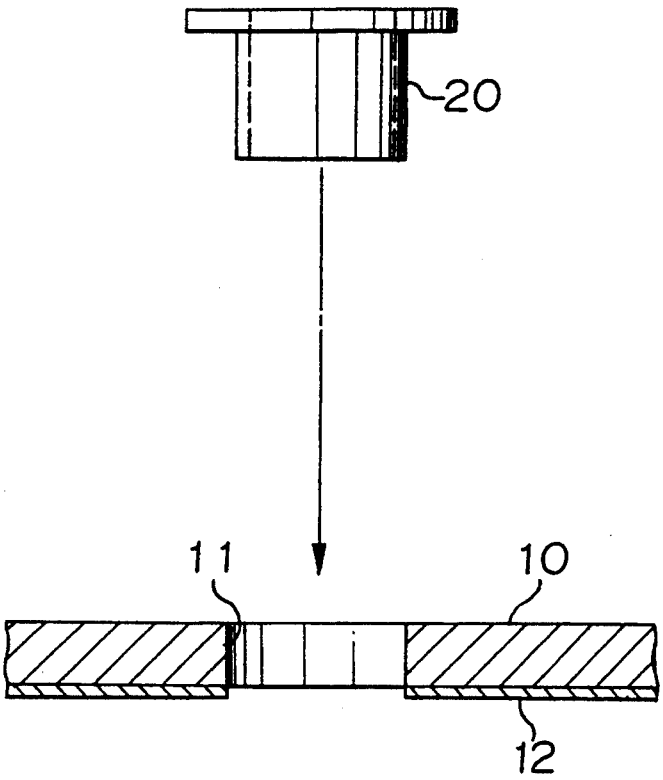
FIG. 7 PRIOR ART
FIG. 7 is an explanatory drawing showing the grommet equivalent to the conventional electric wire-connecting terminal being inserted in the printed circuit board.
Figure 8:
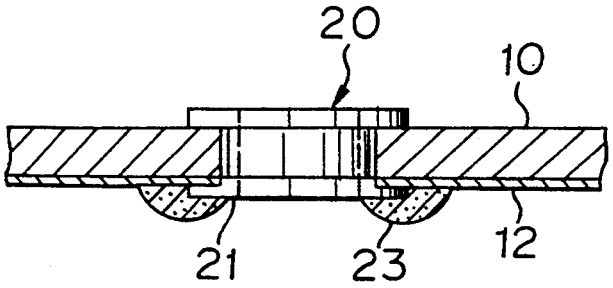
FIG. 8 PRIOR ART
FIG. 8 is a sectional view showing the grommet equivalent to the conventional electric wire-connecting terminal inserted in the printed circuit board.

As shown in FIG. 6, the electric wire-connecting terminal 30 is punched out from sheet metal so as to form a cylindrical sleeve 31 and a pair of legs 32, 32, parallel thereto with the legs 32, 32 being at right angles to the flat "head" portion of terminal 30 as shown in FIG. 5 after being punched out.

Although the lead inserting pitch P of the conventional inserting machine is limited by the inserting machine head, by changing the head, it is possible to set forth the pitch P at 5, 10 and 12.5 mm.

By setting forth the pitch between the legs of the terminal at 5 mm., the packaged terminals 30 are able to be inserted in the printed circuit board by using a conventional automatic electronic components inserting machine.

The method of inserting the terminals 30 into the printed circuit board is described as follows.

Every printed circuit board stacked on the board-supplying device is pulled out on a conveyer (not shown) with a manipulating lever and supplied into the automatic inserting machine (not shown). It is then transferred to an X-Y table, set in the specified position by reference pins, and carried under the inserting head.

Figure 3:
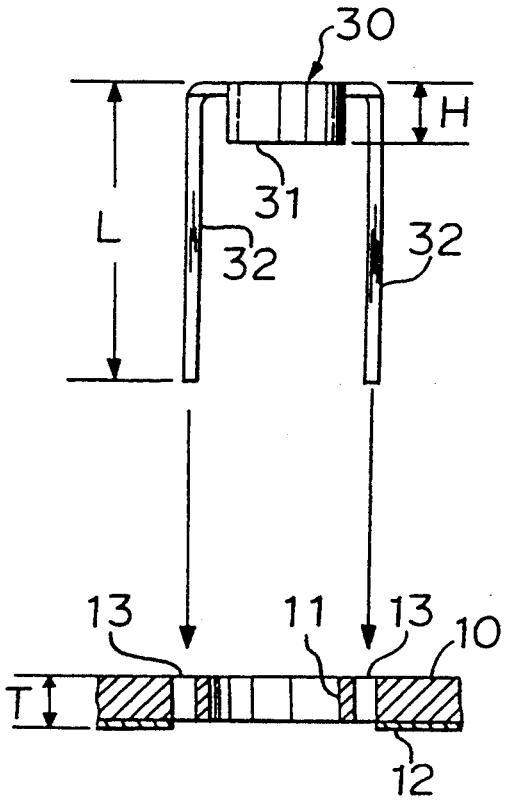
FIG. 3 is an explanatory drawing showing the electric wire-connecting terminal which is to be inserted in the printed circuit board.
Figure 4:
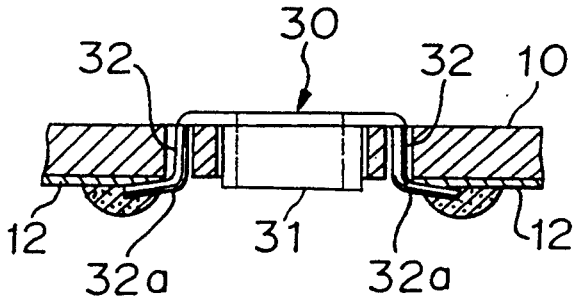
FIG. 4 is a sectional view of the embodiment of the electric wire-connecting terminal according to the present invention, inserted in the printed circuit board.

On the other hand, taped electric wire-connecting terminals 30 according to the present invention and other electronic parts are supplied into the inserting head. Accordingly, as shown in FIG. 3 and FIG. 5, the terminal 30 is inserted in the round hole 10 and the leg inserting holes 13, then the legs are bent for shaping the bent portions 32*a*, 32*a* as shown in FIG. 4.

The bent portions 32*a*, 32*a* are then fixed with solder 23 to the circuit 12 of the printed circuit board 10.

Next, the working of the electric wire-connecting terminal 30 according to the present invention is described as follows.

Up to the present, the terminal-inserting work was performed in two separate steps, namely the grommet-inserting step and the soldering step.

By applying the present invention, it becomes possible to perform the same work at the same time by using the automatic inserting machine. Accordingly, drastic reductions in both labor and costs are achieved by discontinuing use of the grommet and caulking tools, and eliminating the corresponding process.

In other words, by providing a pair of bendable legs installed integrally in one piece on the upper portion of the cylindrical sleeve of the terminal, it becomes possible to fix the electric wire-connecting terminal simultaneously by inserting and soldering same to the printed circuit board using the conventional automatic inserting machine used for inserting electronic parts in a printed circuit board.

Accordingly, the amount of work and the production costs are drastically reduced as no special machines or processes are required.

What is claimed is:

1. An electric wire-connecting terminal for insertion in a printed circuit board using a conventional automatic electronic parts-inserting machine, without the need for inserting and caulking of a grommet first in an aperture for seating said terminal, comprising:

a cylindrical sleeve for insertion in a hole provided for said terminal on said printed circuit board; and a pair of extending legs integrally formed as one piece with said cylindrical sleeve, said legs being at generally right angles to a flat head portion of said terminal, and said legs protruding from beneath said board, and being bendable in predetermined directions after insertion into said boards; whereby said automatic electronic panns-inserting machine is used to simultaneously insert and solder said legs of the terminal to a circuit of said board without the prior need to insert an caulk a grommet in the aperture seating said terminal, thereby substantially reducing labor and other costs normally associated with such assembly operations.

2. The electric wire-connecting terminal according to claim 1, wherein said legs are generally elliptical in profile.

* * * * *